United States Patent [19]

Takase et al.

[11] 3,967,486

[45] July 6, 1976

[54] TOUGHENING ROLL DIE WORK METHOD FOR METALLIC MATERIAL

[75] Inventors: Seiji Takase; Yoshiki Oshida, both of Yokohama, Japan

[73] Assignee: Mitsubishi Jukogyo Kabushiki Kaisha, Tokyo, Japan

[22] Filed: Dec. 31, 1974

[21] Appl. No.: 537,829

[30] Foreign Application Priority Data

Jan. 18, 1974 Japan ..... 49-8366

[52] U.S. Cl. ..... 72/69; 72/364; 72/DIG. 28

[51] Int. Cl.[2] ..... B21B 9/00

[58] Field of Search ..... 72/69, 200–202, 72/364, DIG. 28; 148/11.5, 12

[56] References Cited

UNITED STATES PATENTS

| | | | |
|---|---|---|---|
| 3,652,969 | 3/1972 | Wilson et al. | 148/11.4 S R X |
| 3,694,269 | 9/1972 | Bailey et al. | 148/12 R X |
| 3,805,571 | 4/1974 | Toda et al. | 72/202 |
| 3,877,281 | 4/1975 | Shimizu et al. | 72/364 |

*Primary Examiner*—Lowell A. Larson
*Attorney, Agent, or Firm*—Cushman, Darby & Cushman

[57] ABSTRACT

A method of working metallic material with roll dies resulting in toughening of the worked material is herein described, which method is characterized in that said metallic material is worked with roll dies while generating super-plastic phenomena by applying a temperature cycle passing over a transformation point to said metallic material.

1 Claim, 3 Drawing Figures

TOUGHENING ROLL DIE WORK METHOD FOR METALLIC MATERIAL

The present invention relates to a method of subjecting a metallic workpiece to roll die work while generating superplastic phenomena in said metallic article to be worked.

Heretofore, in case of working workpieces with roll dies, SCM or SNCM material that is added with additive elements such as Ni, Cr, Mo, etc. has been employed to enhance a strength of the article to be worked. Still further, these workpieces made of special steel were subjected to heat treatment to improve a tension strength and a fatigue strength. In addition, in a roll die work process for bolts and the like, the roll die working at a room temperature required a large roll die working energy, because upon working, the radius of curvature at a small angle portion in a notch, for example, was selected as large as possible in order to prevent stress concentration caused by notching of a thread portion.

Therefore, it is an object of the present invention to provide a method of working with roll dies, in which even a workpiece made of rolled steel material for general construction use, can be improved in strength up to an extent similar to that of special steel, and in which the energy required for the roll die working can be minimized.

According to one feature of the present invention, there is provided a toughening roll die work method for metallic material characterized in that said metallic material is worked with roll dies while generating super-plastic phenomena by applying a temperature cycle passing over a transformation point to said metallic material.

Figure 1:
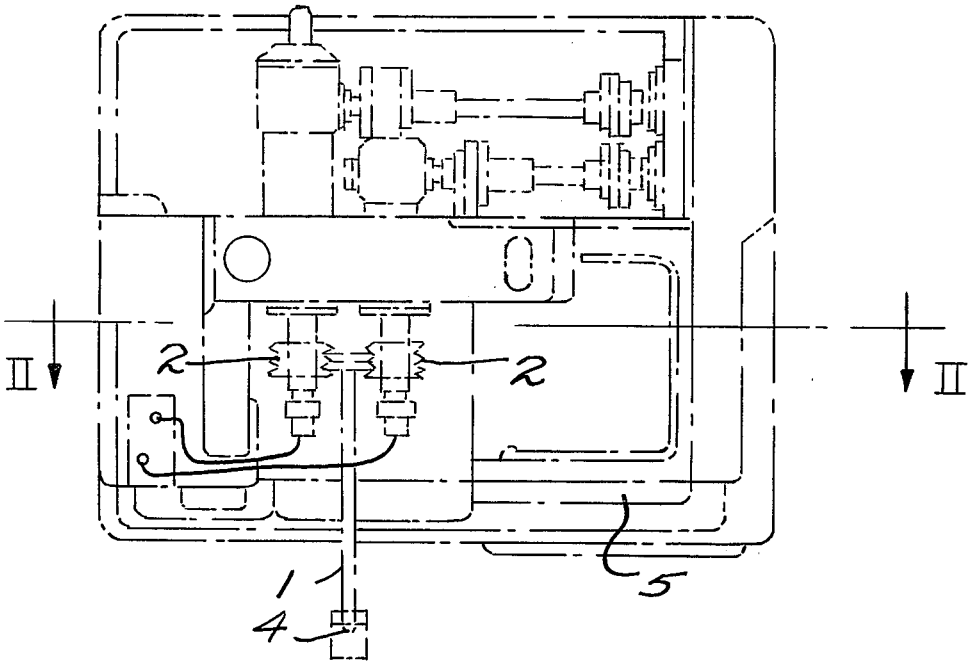
Figure 2:
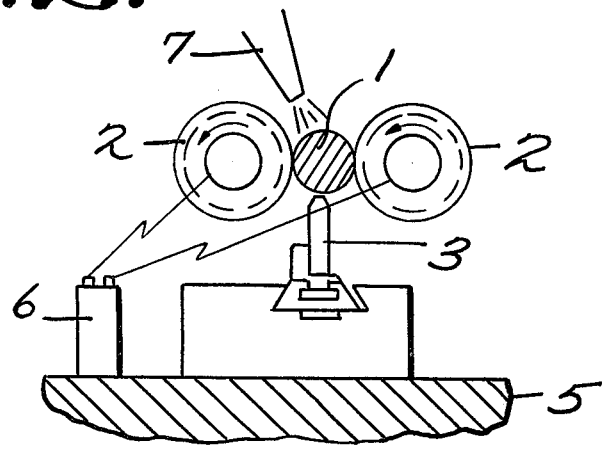
Figure 3:
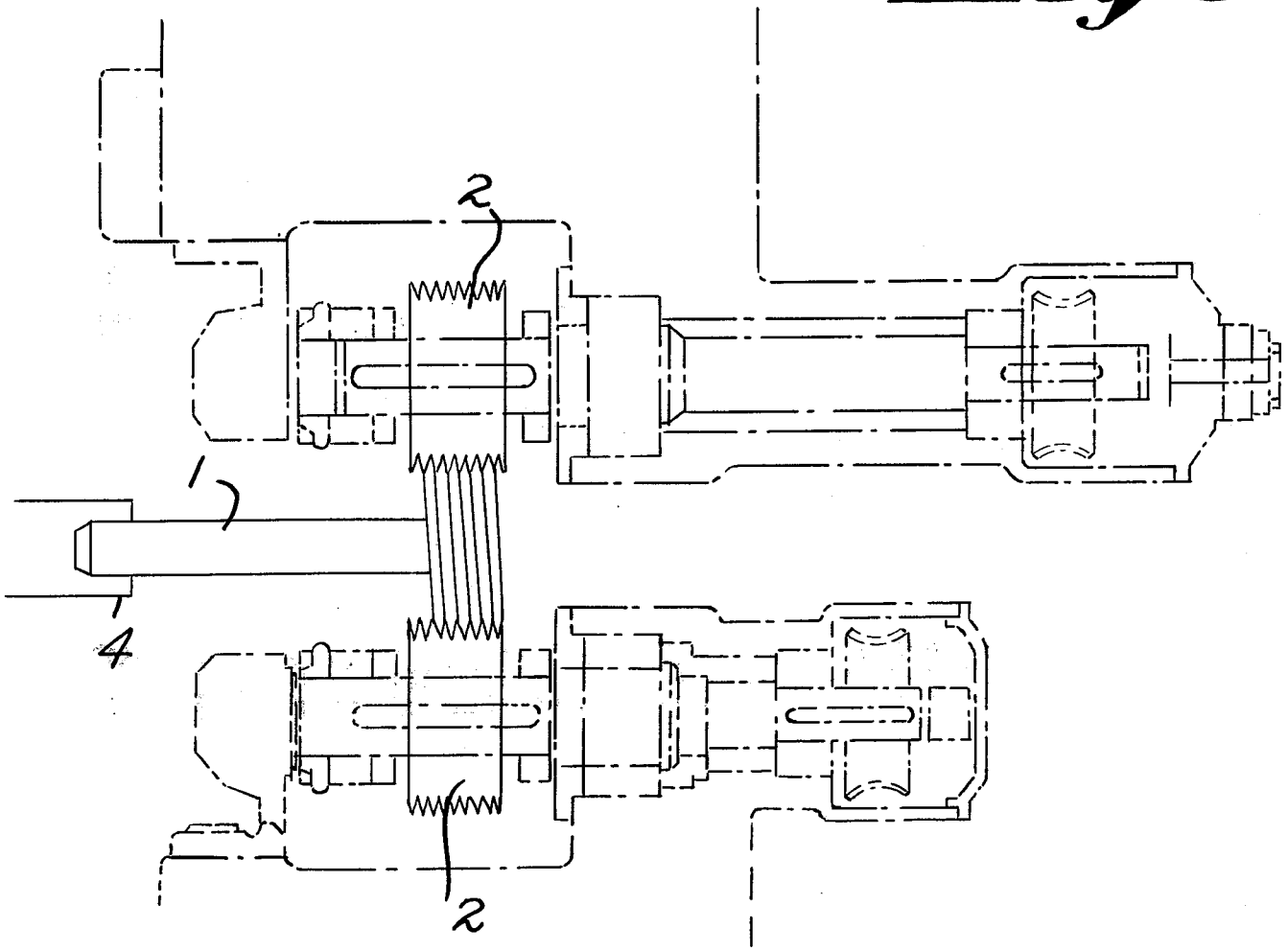

Above-mentioned and other features and objects of the invention will become more apparent by reference to the following description taken in conjunction with the accompanying drawings, in which:

FIG. 1 is a plan view of a roll die working device which is adapted to practice the toughening roll die work method according to the present invention, FIG. 2 is a vertical cross-section view taken along line II—II in FIG. 1 as viewed in the direction of arrows, and FIG. 3 is an enlarged partical plan view of the same device.

The method of working metallic material with roll dies resulting in toughening of the worked material according to the present invention will be now described in detail with reference to FIGS. 1 to 3.

A roll die working device similar to that used in the prior art is employed, in which roll dies 2 are driven by an electric motor not shown, a workpiece 1 is supported by a support plate 3 which is fixedly secured to a base frame 5, and one end of the workpiece 1 is rotatably supported by a support member 4. An electric power supply 6 for heating the workpiece 1 is provided on the base frame 5, and the power supply 6 is connected to the roll dies 2 to pass an electric current through the workpiece 1 for heating the same. But the drive shafts of the roll dies 2 are insulated from the corresponding roll dies 2. In order to cool the workpiece 1, a cooling device 7 for blowing pressurized air to the workpiece 1 is provided.

In case that a workpiece is made of, for example, steel (a circular steel rod of 15mm $\phi$ made of SC material), the workpiece 1 is subjected to a heating and cooling temperature cycle of 4 – 5 cycles per minute passing through a transformation point over a temperature range including an $A_1$ transformation point (that is, the range of about ± 100°C, in the proximity of the $A_1$ transformation point, or the temperature range including the $A_1$ and $A_2$ transformation points having a lower limit at a temperature about 100°C lower than the $A_1$ transformation point and having an upper limit at a temperature about 100°C higher than the $A_2$ transformation point). During this period, owing to occurrence of super-plastic phenomena in the workpiece 1, fining of crystal grains in the workpiece and equalization of metallurgical structure would occur, and a sufficient strength of the workpiece can be realized by the equalization in the minute metallurgical structure of the crystal grains. In addition, since the roll die working is carried out under the state where super-plastic phenomena have occurred in the workpiece, the energy required for roll die working can be also minimized.

It is to be noted that in the above-described embodiment, the temperature range between its upper and lower limits is specified as about ± 100°C in the proximity of a transformatiсn point, and the cycles of the temperature variation is specified as 4 – 5 cycles per minute, and that these specific values have been determined by taking into consideration the variation of the transformaton point caused by the variation of the heating and cooling speeds, and the time required between commencement and termination of the transformation. Upon practicing the present invention, the operating conditions such as the temperature range of the thermal cycle passing through the transformation point up and down and the cycle frequency can be appropriately selected depending upon the nature and shape of the material of the workpiece. Though it is necessary for generating super-plastic phenomena to apply a low stress to the workpiece, the pressing stress of the workpiece caused by the roll dies is sufficient for that purpose. The temperature measurements in the above-described operation are conventionally achieved by disposing a PbS thermal radiometer in the proximity of the workpiece or by directly mounting a thermocouple onto the workpiece.

Here it is to be noted that the workpiece 1 is preliminarily heated up to the proximity of the transformation point and the electric current fed from the power supply 6 to the workpiece 1 is used to controllably heat the workpiece to a desired temperature. Otherwise, the heating of the workpiece 1 could be achieved either by leading an electric current directly to the workpiece 1 through brushes or by blowing a high temperature gas to the workpiece 1. Furthermore, the cooling device 7 could be omitted, leaving the workpiece under natural cooling. According to the present invention, even in the case of employing rolled steel material for general construction use, a strength similar to that of special steel can be obtained, and also the heat treatment which is required in the case of special steel is unnecessary. Furthermore, since the workpiece is processed under a condition having super-plasticity, toughening of the workpiece by fining its crystal grains as well as roll die working of the same can be achieved in one step, and the energy required for the roll die working can be minimized because the workpiece is made super-plastic. With regard to the materials of the workpiece, a similar effect can be obtained in case of both ferrous materials and non-ferrous materials (having a transformation point).

In summary, according to the present invention, metallic material is subjected to roll die working while generating superplastic phenomena in said metallic material by applying a temperature cycle passing over a transformation point, and thereby it is made possible to obtain a tough roll die worked body with a minimum working energy. Therefore, this invention is greatly useful in industry.

While we have described above the principle of the present invention in connection with specific apparatus it is to be clearly understood that this description is made only by way of example and not as a limitation to the scope of the invention as set forth in the objects thereof and in the accompanying claims.

What is claimed is:

1. A method for toughening a work piece made of a metal having at least one transformation point, by roll die working the workpiece, comprising:

a. heating the workpiece to the proximity of a transformation point;

b. subjecting the workpiece to roll die working with sufficiently low stress on the work piece as to permit the generation of super-plastic phenomena, while c. generating super-plastic phenomena in the workpiece by alternately i. heating the workpiece to surpass said at least one transformation point by up to 100°C, and ii. cooling the workpiece to below said at least one transformation point by up to 100°C, at frequency of alternation of about 4–5 cycles per minute.

* * * * *